United States Patent [19]

Schwarz et al.

[11] 3,953,256

[45] Apr. 27, 1976

[54] PROPELLANTS AND PYROTECHNIC COMPOSITIONS CONTAINING ALUMINUM-COATED AMMONIUM PERCHLORATE

[75] Inventors: William W. Schwarz; William D. Stephens, both of Huntsville, Ala.

[73] Assignee: Thiokol Corporation, Newtown, Pa.

[22] Filed: Aug. 22, 1973

[21] Appl. No.: 390,455

[52] U.S. Cl. ..... 149/5

[51] Int. Cl.[2] ..... C06B 45/34

[58] Field of Search ..... 149/5, 76

[56] References Cited

UNITED STATES PATENTS

| | | | |
|---|---|---|---|
| 3,120,459 | 2/1964 | Coates et al. | 149/5 |
| 3,147,160 | 9/1964 | McCrone | 149/5 |
| 3,390,026 | 6/1968 | Cerych et al. | 149/5 |
| 3,830,673 | 8/1974 | Shafer et al. | 149/76 |

*Primary Examiner*—Leland A. Sebastian

*Attorney, Agent, or Firm*—Stanley A. Marcus; Royal E. Bright

[57] ABSTRACT

A method for improving the combustion efficiency, i.e. increasing the burning rate, of propellant, flare, and other pyrotechnic compositions is disclosed which comprises using at least some ammonium perchlorate oxidizer coated with aluminum metal in place of a mere mixture of aluminum and ammonium perchlorate. The resultant compositions have increased burning rate in comparison to mere mixtures of ammonium perchlorate and aluminum.

2 Claims, No Drawings

PROPELLANTS AND PYROTECHNIC COMPOSITIONS CONTAINING ALUMINUM-COATED AMMONIUM PERCHLORATE

BACKGROUND OF THE INVENTION

1. Field of the Invention

Certain solid propellants, tracer compositions, incendiaries, flares, and other pyrotechnics are made from solid inorganic or organic oxidizers, metal fuels, and binders. While the specific compositions vary depending on end use characteristics, they all have in common the basic ingredients of oxidizer, metal fuel, and binder. In certain applications, these compositions must be adjusted or modified to obtain burning rates which are higher than those obtainable by ordinary combustion processes. Oftentimes, the burning rates of these materials have been increased by use of combustion modifiers or burning rate catalysts, but these additives have the disadvantage of increasing the sensitivity of the resultant composition towards friction, heat, impact, or electrostatic discharge.

2. Description of the Prior Art

Ferrocene compounds and various metal oxides have been used in the past for increasing the burning rates of these compositions. Another means of increasing the burning rates of these materials is through the incorporation of metallic fibers within the composition. These metallic fibers are added so as to provide a means of conducting heat from the combustion zone into the burning composition. One of the difficulties encountered in the use of such metallic fibers is the problem associated with the alignment of the fibers. During casting and loading operations the flow patterns of the composition provide non-uniform distribution of metallic fibers which causes uneven and irregular burning during the combustion process. As a result, the use of fibers as a means of conducting heat into the composition has never reached the desired level of proficiency.

Other attempts to achieve greater influx of heat from the combustion zone to the surface of the composition have involved making intimate mixtures of the metal powder (magnesium or aluminum) and oxidizer powder in order to try to force the metal combustion to occur as close as possible to the surface of the composition. These attempts have been largely unsuccessful, and graphic evidence is available. High speed motion pictures showing these compositions undergoing combustion shows aluminum particles leaving the surface of the composition and igniting at some finite distance away from the surface, thereby depriving the surface of heat which would allow the composition to burn at a higher rate.

In order to overcome the problems with regard to obtaining good combustion of the aluminum powder very near the surface of the composition the instant invention deals with a manner of treating the solid ammonium perchlorate oxidizer so as to cause aluminum metal to be combusted at or very near the surface of the composition, thereby providing a greater heat release in the critical area, resulting in increases in the composition burning rate. This result is produced by using an aluminum coated ammonium perchlorate in a binder, as opposed to a mere mixture of aluminum and ammonium perchlorate.

Oxidizers other than ammonium perchlorate have been coated in the past, U.S. Pat. No. 3,120,459 and 3,535,172, to produce more stable oxidizers, but the use of the coated oxidizers, especially ammonium perchlorate, to control, modify, or in any way effect the burning rate has not been heretofore disclosed.

SUMMARY OF THE INVENTION

This invention, therefore, relates to a method of increasing the burning rate of various propellant, incendiary, flare and other pyrotechnic compositions by coating the oxidizer with a film of aluminum metal. The objective of the present invention is to provide a means of increasing the combustion rate of these compositions by using ammonium perchlorate oxidizer particles which are coated with aluminum metal to thereby provide the intimacy of contact necessary to achieve combustion of the metal at or very close to the composition surface. The heat released by this reaction very close to the surface provides a higher decomposition rate and therefore a higher overall combustion rate for the pyrotechnic composition.

It is a further object of this invention to provide the improved burning rate without sacrifices in the sensitivity characteristics of the compositions.

An advantage of this invention is that it provides these increases in burning rate while providing a degree of protection of the oxidizer particle from attack by atmospheric moisture.

These and other objectives of the present invention are achieved by coating aluninum metal on the surface of the solid ammonium perchlorate oxidizer.

The above and other object and advantages will, it is believed, become more apparent to one skilled in the art from the following detailed description and examples.

DESCRIPTION OF THE PREFERRED EMBODIMENTS

A particularly advantageous method of producing the aluminum coated ammonium perchlorate (AlCAP) useable herein is by vapor phase deposition of aluminum metal on the ammonium perchlorate oxidizer. Alternatively, any other method of obtaining a coating of aluminum on the ammonium perchlorate may be used.

Vapor phase deposition was performed by placing the ammonium perchlorate in a vacuum chamber containing a small electrically heated tungsten element furnace used for melting and evaporating aluminum metal. The aluminum was then placed in the furnace and the entire apparatus evacuated to a pressure below $10^{-4}$ torr. The tungsten element was connected to a power source and the power was then increased to give a white hot heat such that the aluminum evaporated away from the furnace and unto the surfaces of the ammonium perchlorate which was magnetically stirred. The apparatus was then allowed to cool to room temperature and air was slowly diffused into the vacuum. The resultant AlCAP was then used in pyrotechnic compositions as shown in the Examples below.

The above procedure for making AlCAP was performed on 200$\mu$, 50$\mu$, and 5.5$\mu$, ammonium perchlorate and resulted in an aluminum content of 1%, 1%, and 3.5% respectively. The preferred aluminum content of AlCAP is from about 0.5 to 5.0%, though additional aluminum would not be detrimental so long as the amount is insufficient to place the mixture in the hazardous explosive region, i.e. above about 8% aluminum.

The pyrotechnic compositions of which the burning rate is increased by the use of AlCAP may contain any of the conventional binder systems which are all well known in the art.

The AlCAP may be used either with or without additional ammonium perchlorate and/or aluminum powder. When additional ammonium perchlorate, i.e. uncoated, is used, the amount of AlCAP employed is a function of the desired increase in burning rate. Thus, the AlCAP can be used in an amount as low as 5% of the total oxidizer, preferably at 30%. Additional aluminum may account for up to about 30% of the total pyrotechnic composition.

EXAMPLE 1

Propellants were formulated with 81% solids and 19% binder. The solids were the ammonium perchlorate and the aluminum, first as AlCAP and then as a mere mixture of the aluminum and the ammonium perchlorate. The binder was based on carboxy-terminated polybutadiene..A comparison of these propellants (one with AlCAP and one a mere mixture) indicated a 50% increase in burning rate for the 200 AlCAP sample over the 200$\mu$ mixture, and a 30% increase in burning rates for the 50$\mu$ samples. These results are summarized in Table I wherein is included results of sensitivity to impact, spark, and friction.

TABLE I

| RESULTS OF EXAMPLE 1 | | | | |
|---|---|---|---|---|
| Ingredient, % | a | b | c | d |
| Binder | 19 | 19 | 19 | 19 |
| Aluminum, 3$\mu$ | | 1 | | 1 |
| Ammonium perchlorate, 200$\mu$ | | 80 | | |
| AlCAP, 200$\mu$ | 81 | | | |
| Ammonium perchlorate, 50$\mu$ | | | | 80 |
| AlCAP, 50$\mu$ | | | 81 | |
| Burn Rate ($N_2$Bomb) | | | | |
| $R_b$ at 500 psig, in/sec | .295 | .21 | .515 | .35 |
| $R_b$ at 1000 psig, in/sec | .46 | .305 | .65 | .485 |

TABLE I-continued

| RESULTS OF EXAMPLE 1 | | | | |
|---|---|---|---|---|
| Ingredient, % | a | b | c | d |
| Sensitivity (No Fire Level) | | | | |
| Impact, kg-cm | 50 | 50 | 40 | 40 |
| Friction, lbs. | 80 | 55 | 80 | 55 |
| Spark, joules | 25 | 25 | 25 | 25 |

EXAMPLE 2

The procedure of Example 1 was repeated except using a hydroxy-terminated polybutadiene binder with a diisocyanate curative and a bimodal distribution of ammonium perchlorate, in one case part of which was the AlCAP. The results shown in Table II indicate a 15–20% increase in the burning rate merely by the use of 22% AlCAP instead of standard ammonium perchlorate.

TABLE II

| RESULTS OF EXAMPLE 2 | | |
|---|---|---|
| Ingredient, % | a | b |
| Binder | 14 | 14 |
| Aluminum | 16 | 16 |
| Ammonium Perchlorate, 50$\mu$ | 48 | 48 |
| Ammonium Perchlorate, 5.5$\mu$ | 22 | |
| AlCAP, 5.5$\mu$ | | 22 |
| Burn Rate (Oil Bomb) | | |
| $R_b$ at 2000 psi, in/sec | .79 | .91 |
| $R_b$ at 1000 psi, in/sec | .61 | .72 |

What is claimed is:

1. In a pyrotechnic composition comprising aluminum metal, ammonium perchlorate and a binder, the improvement which comprises replacing at least 5% of said ammonium perchlorate with aluminum-coated ammonium perchlorate.

2. A composition as described in claim 1 wherein from at least 5% to about 30% of the ammonium perchlorate is replaced by aluminum-coated ammonium perchlorate.

* * * * *